US006604786B1

(12) United States Patent
Benden et al.

(10) Patent No.: US 6,604,786 B1
(45) Date of Patent: Aug. 12, 2003

(54) SUPPORT APPARATUS FOR A CHAIR

(75) Inventors: Mark E. Benden, College Station, TX (US); Jerome J. Congleton, College Station, TX (US); N. Michele Smithey, Bryan, TX (US)

(73) Assignee: Neutral Posture, Inc., Bryan, TX (US)

( * ) Notice: Subject to any disclaimer, the term of this patent is extended or adjusted under 35 U.S.C. 154(b) by 0 days.

(21) Appl. No.: 09/588,246

(22) Filed: Jun. 6, 2000

(51) Int. Cl.[7] ..... A47C 7/68; A47C 7/62

(52) U.S. Cl. ..... 297/188.06; 297/188.18; 297/163; 297/166; 297/153

(58) Field of Search ..... 297/135, 153, 297/148, 163, 188.2, 188.06, 188.14, 251, 166, 344.18, 344.19, 188.18; 108/11, 12, 50.14

(56) References Cited

U.S. PATENT DOCUMENTS 3,017,219 A * 6/1962 Mallet ..... 297/135
3,093,411 A * 6/1963 Mallet ..... 297/135 X
3,336,076 A * 8/1967 Malitte ..... 297/148
4,453,764 A * 6/1984 Hennessy ..... 297/153
4,659,099 A * 4/1987 Malone ..... 297/153 X
4,779,922 A 10/1988 Cooper
5,104,073 A 4/1992 VanBeek et al. ..... 248/118.3
5,161,812 A * 11/1992 DeWeese ..... 297/344.19 X
5,311,210 A 5/1994 O'Brien et al.
5,452,950 A 9/1995 Crenshaw et al. ..... 312/223.3
5,490,710 A 2/1996 Dearing et al. ..... 297/162
5,893,607 A 4/1999 Trimnell ..... 297/170
6,095,607 A * 8/2000 Wenzel ..... 297/344.18 X
6,135,548 A * 10/2000 McGuire ..... 297/163

OTHER PUBLICATIONS

"Neutral Posture® Sit/Stand Workstation for Office or Industry", Neutral Posture Ergonomics, Inc. © (P11,6/99).
"Providing High–Quality Products to Enhance Your Comfort, Safety and Productivity", Ergonomic Design Inc. © 1999.
"Give Yourself C.P.R. Comfort Productivity Risk Reduction", Cat Trak, Inc. © 1999.

* cited by examiner

*Primary Examiner*—Anthony D. Barfield
(74) *Attorney, Agent, or Firm*—Howrey Simon Arnold & White, LLP

(57) ABSTRACT

A support apparatus is described for use in the field of workstation design. The support apparatus is removably attachable to either the armrest of the chair, the back of the chair, or a desk. In this way, accessories—such as a computer, keyboard and/or a mouse—can be utilized by a person seated in the chair or standing near the chair. Also described is a support apparatus having two sides rotatably attachable to a chair.

9 Claims, 19 Drawing Sheets

SUPPORT APPARATUS FOR A CHAIR

BACKGROUND OF THE INVENTION

1. Field of the Invention

The invention relates to an accessory support for a chair. More particularly, this invention relates to a support apparatus to hold accessories, such as a keyboard, mouse, and/or laptop computer, for a user to use while either sitting in a chair or standing near the chair. This allows a user to change from a seated to a standing position throughout the workday while utilizing only one accessory support apparatus.

2. Description of the Related Art

In the workplace, persons are often required to perform repetitive manual tasks in a sedentary position. By maintaining a sedentary position throughout the workday, the person can become fatigued and blood flow through the legs is less than ideal. By utilizing ergonomic principles when designing furniture, worker productivity is increased, worker fatigue and absenteeism are decreased, and blood flow throughout the body is improved.

It is desirable to properly support the hands, arms, and wrists of a seated person who is utilizing accessories such as a computer keyboard, mouse, and/or laptop computer. However, remaining in a seated position decreases the person's productivity. Without changing positions periodically, proper circulation is hampered.

It is known in the workstation design industry that by varying a person's body position, fatigue is reduced. By changing body positions at multiple times throughout the day, a person can reduce stress and increase productivity.

One desirable way of changing body position is for a worker to switch from a seated to a standing position. Alternating from a seated to a standing position facilitates blood flow through the legs which helps prevent fatigue and improves worker comfort. This sit-and-stand method of reducing worker fatigue is known in the furniture design field.

Several attempts at providing a comfortable keyboard support for a seated person are known. It is known in the workplace design industry that it is possible to provide keyboard supports for use by a person in a seated position. For example, the approach of Trimnell described in U.S. Pat. No. 5,893,607 utilizes a computer keyboard holder attached to a chair. Trimnell's keyboard holder attaches to the chair legs, and is for use by a person in the seated position, not the standing position. Alternatively, U.S. Pat. No. 4,779,922 to Cooper describes a chair with a built-in computer workstation. U.S. Pat. No. 5,104,073 to VanBeek describes the holder in front of a chair to reduce the chance of the user incurring repetitive stress injuries. U.S. Pat. No. 5,422,950 to Crenshaw describes a school desk computer workstation, while Dearing (U.S. Pat. No. 5,490,710) describes the holder built into a chair arm.

Commercial products such as X-TENSION ARM by Cal Trak, Inc. of Broomfield, Colo., and ERGOREST by Ergonomic Design, Inc. of Northglenn, Colo., are available which provide for the attachment of a keyboard support to a chair, the support being mounted at a given height for a seated user.

In each of these approaches, the holder is designed for only one position of a user, generally seated. None describe a system for providing a keyboard support for a use by a person standing near a chair. Further, when a user is practicing those prior designs, but would like to stand to take advantage of the sit-and-stand principle, modifications to the work area would be required. For instance, combining two prior design support systems could possibly be used to accommodate different user positions.

It is known to provide two keyboard supports at one workstation: one permanently mounted at a height suitable to a person in a seated position, and one permanently mounted at a height suitable to a person in a standing position. However, the addition of another piece of furniture in the work area is not always desirable in many space-limited workplace designs. Further, the same keyboard, mouse, and/or computer may be utilized by multiple workers throughout the day. Therefore, it is desirable to have accessory supports which are capable of adjusting to the different depths, angles, and heights to accommodate the differently-statured individuals which may utilize the same keyboard support. Additionally, the use of radio frequency or infra red communication makes the use of a cordless keyboard, mouse, or computer feasible in the modern workplace.

For the foregoing reasons, there is a need for a single, versatile support to hold accessories, such as a keyboard, mouse, or laptop computer, of a user. It is desirable that this support be capable of attaching to a user's chair in such a way as to let the user sit or stand throughout the day, thus reducing worker fatigue. It is therefore desirable that the attachment mechanism be simple to use so that the user can change positions as desired. Further, it is desirable that the support be easily adapted for use by multiple persons throughout the workday: the support should be able to rotate and tilt to support the accessories at comfortable positions for multiple users.

SUMMARY OF THE INVENTION

In some aspects, an apparatus is described to support accessories on a chair having an armrest and a back comprising a deck having a substantially flat upper surface to hold accessories, a first attachment means connected to said deck, said deck being removably attachable to said armrest of said chair via said first attachment means, and a second attachment means attached to said deck, said deck being removably attachable to said back of said chair via said second attachment means. The apparatus the deck may further comprise a raised edge to prevent the accessories from falling off said deck, said raised edge being located on a side of said deck. The first attachment means may further comprise a first tilt pivot having one degree of freedom to rotate said deck about a first horizontal axis to angle said deck from a horizontal plane. And the second attachment means may further comprise a second tilt pivot having one degree of freedom to rotate said deck about a second horizontal axis to angle said deck from a horizontal plane. And the first attachment means may further comprise a first rotational pivot having one degree of freedom to rotate a first longitudinal axis of said deck about the first rotational pivot. The second attachment means may also further comprise a second rotational pivot having one degree of freedom to rotate a second longitudinal axis of said deck about the second rotational pivot. In this way, one apparatus may be used to accommodate proper ergonomic position of multiple users. Further, each user is able—with one apparatus—to utilize the advantageous sit-and-stand principle.

In some embodiments, the first and or the second attachment means is a clamp. In others the second attachment means is a clamp. In some embodiments, the first and or the second attachment means is a gravity holder. In some embodiments, the second attachment means is a custom bar.

In other aspects, an apparatus is described to support accessories on a chair having an armrest and a back, comprising a deck having a substantially flat upper surface to hold accessories, said deck having a raised edge to prevent the accessories from falling off said deck, said raised edge being located on a side of said deck, a first attachment means connected to said deck, said deck being removably attachable to said armrest of said chair via said first attachment means, and a second attachment means attached to said deck, said deck being removably attachable to said back of said chair via said second attachment means, said first attachment means having a first tilt pivot with one degree of freedom to rotate said deck about a first horizontal axis to angle said deck from a horizontal plane, said first attachment means having a first rotational pivot with one degree of freedom to rotate said deck about the first rotational pivot, said second attachment means having a second tilt pivot with one degree of freedom to rotate said deck about a second horizontal axis to angle said deck from a horizontal plane, said second attachment means having a second rotational pivot with one degree of freedom to rotate said deck about the second rotational pivot.

In other embodiments, an apparatus to support accessories on a chair having an armrest and a back is described having a means for supporting accessories, a means for removably attaching said means for supporting accessories to said armrest of said chair, said means for removably attaching said means for supporting accessories to said armrest of chair being attached to said means for supporting accessories, and a means for removably attaching said means for supporting accessories to said back of said chair, said means for removably attaching said means for supporting said armrest of chair being attached to said means for supporting accessories.

Also described is a method of attaching an apparatus to a chair having an armrest and a back, comprising providing an apparatus to support accessories having a deck having a substantially flat upper surface to hold accessories, a first attachment means connected to said deck, said deck being removably attachable to said armrest of said chair via said first attachment means, and a second attachment means attached to said deck, said deck being removably attachable to said back of said chair via said second attachment means, attaching said apparatus to said arm rest via said first attachment means, and placing said accessories on said deck. In some aspects, the method further comprising rotating said deck about a rotational pivot. In some aspects, the method further comprising tilting said deck about a tilt pivot. In other aspects, the method includes adjusted the vertical height of the deck for users of various heights by adjusting the height of the chair.

In other embodiments, in combination with a chair having an armrest and a back, an apparatus to support accessories is described comprising a deck having a substantially flat upper surface to hold accessories, a first attachment means connected to said deck, said deck being removably attachable to said armrest of said chair via said first attachment means, and a second attachment means attached to said deck, said deck being removably attachable to said back of said chair via said second attachment means. In others, the second attachment means further comprises a slot located in the back of said chair and a plug located on the deck, the deck being removably attachable to the back of said chair by inserting the plug located on the deck into the slot located in the chair back. The second attachment means further may comprise a second rotational pivot having one degree of freedom, to rotate a second longitudinal axis of said deck about the second rotational pivot. The second attachment means may further comprise a second tilt pivot having one degree of freedom, to tilt a second horizontal axis of said deck about the second rotational pivot.

In other aspects, in combination with a chair having a chair arm and a back, an apparatus is described to support accessories comprising an arm rest being rotatably attached to the chair arm, an arm rest base being attached to said arm rest, a deck base being moveably attached to said arm rest base, a deck having a substantially flat upper surface to hold accessories, the deck being attached to the deck base, and a second attachment means attached to said deck, said deck being removably attachable to said back of said chair via said second attachment means. In some aspects, the deck base further comprises a deck track, the arm rest base being moveably attached to the deck tracks to allow a position of the deck to be adjusted relative to a user seated in the chair. In others, the second attachment means further comprises a second rotational pivot having one degree of freedom to rotate a second longitudinal axis of said deck about the second rotational pivot. In others, the second attachment means further comprises a second tilt pivot having one degree of freedom, to tilt a second horizontal axis of said deck about the second rotational pivot.

In other aspects, in combination with a desk and a chair having a back, an apparatus is described to support accessories comprising a deck having a substantially flat upper surface to hold accessories, a first attachment means connected to said deck, said deck being removably attachable to said desk via said first attachment means, and a second attachment means attached to said deck, said deck being removably attachable to said back of said chair via said second attachment means. In some embodiments, the first attachment means further comprises a first tilt pivot having one degree of freedom, to rotate said deck about a first horizontal axis to angle said deck from a horizontal plane. In other embodiments, the second attachment means further comprises a second tilt pivot having one degree of freedom, to rotate said deck about a second horizontal axis to angle said deck from a horizontal plane. In others, the first attachment means further comprises a first rotational pivot having one degree of freedom, to rotate a first longitudinal axis of said deck about the first rotational pivot. In some embodiments, the second attachment means further comprises a second rotational pivot having one degree of freedom, to rotate a second longitudinal axis of said deck about the second rotational pivot.

In another aspect of the invention, an apparatus is described to support accessories on a chair having an armrest and a back, comprising a deck having a substantially flat upper surface and a substantially flat bottom surface, and a mounting bar connected to said deck, said mounting bar being rotatably attachable to said back of said chair via a flip pivot, the accessories being supportable on the substantially flat upper surface when the deck rests upon the armrest, the accessories being supportable on the substantially flat bottom surface when the deck rests upon the back of the chair. In some embodiments, the substantially flat upper surface further comprises a raised edge being located on a side of said substantially flat upper surface. In others, the substantially flat bottom surface further comprises a raised edge being located on a side of said substantially flat bottom surface. In some embodiments, the mounting bar may comprise a first member connected to said deck and a second member connected to said flip pivot, the first member being connected to the second member to form an angle. The angle may be ninety degrees. This embodiment again allows one piece of furniture to be utilized while practicing the advantageous sit-and-stand principle.

Figure 1:
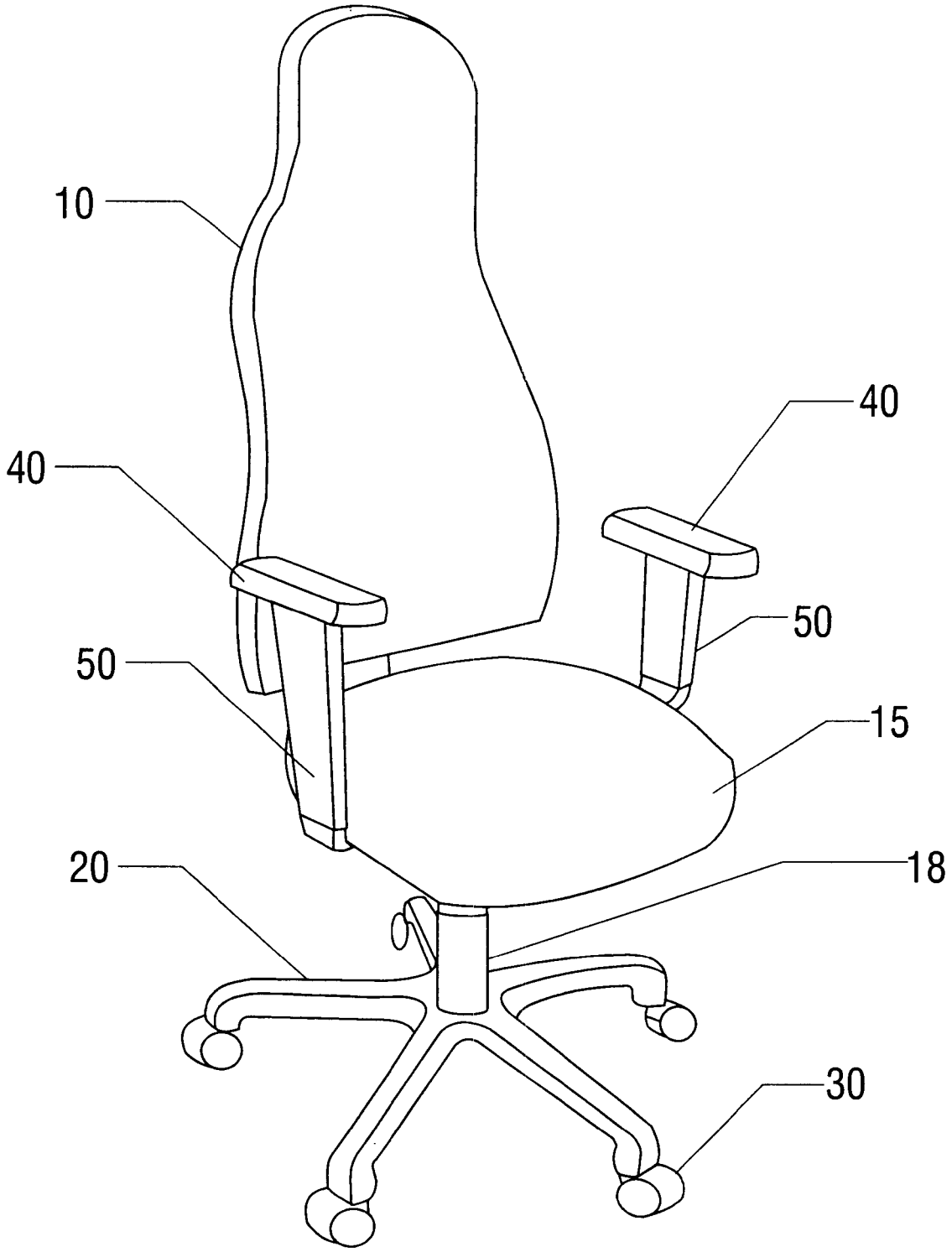
FIG. 1 (Prior Art)
FIG. 1 shows a chair of the prior art.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

The invention relates to an apparatus and a method to support various accessories and a person's hands while utilizing those accessories. In some embodiments, the deck support is capable of various adjustments, such as tilting and rotating the accessory either by adjusting the support, or, if the chair is adjustable, then by adjusting the position of the chair. In some embodiments, the support also is capable of also being attached to the back of the chair, so that the user may utilize the accessory in a standing position. This allows a user to take advantage of the sit-and-stand principle without adding another piece of furniture to the work area. In some embodiments, the support is attached to either the arm rest or back of a chair with a simple clamp, allowing for quick attachment, removal, and adjustment of the support. This is also advantageous if one work area is being utilized by multiple users. In some embodiments, the support is, capable of tilting and rotating to provide additional comfort for the user.

In some embodiments, a deck is described that can be attached to a desk for use by a seated person, then attached to the back of a chair for use by a person in the standing position. Again, this is advantageous from an ergonomics perspective.

Also described is a chair having a slot in its back to mate with a plug on the deck support. In this way, the deck may be quickly and easily moved. The plug may plug into the back of the chair, or may plug into a socket on the side of a desk, for example. Also described is a deck that may be rotated about a flip pivot. The deck is rotated from a position resting on the chair arms to a position resting on the chair back. In this way, the deck is inverted and a user may utilize the same deck in the seated or standing position.

In each of these embodiments, the advantage of using one piece of furniture to support the accessories while the user is seated or standing is utilized. Thus, cost and space is reduced compared to using two pieces of furniture to employ the sit and stand principle.

Illustrative embodiments of the invention are described below as they might be employed in the use of a support that can be hold an accessory, such as a keyboard, mouse, or laptop computer. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

Figure 2:
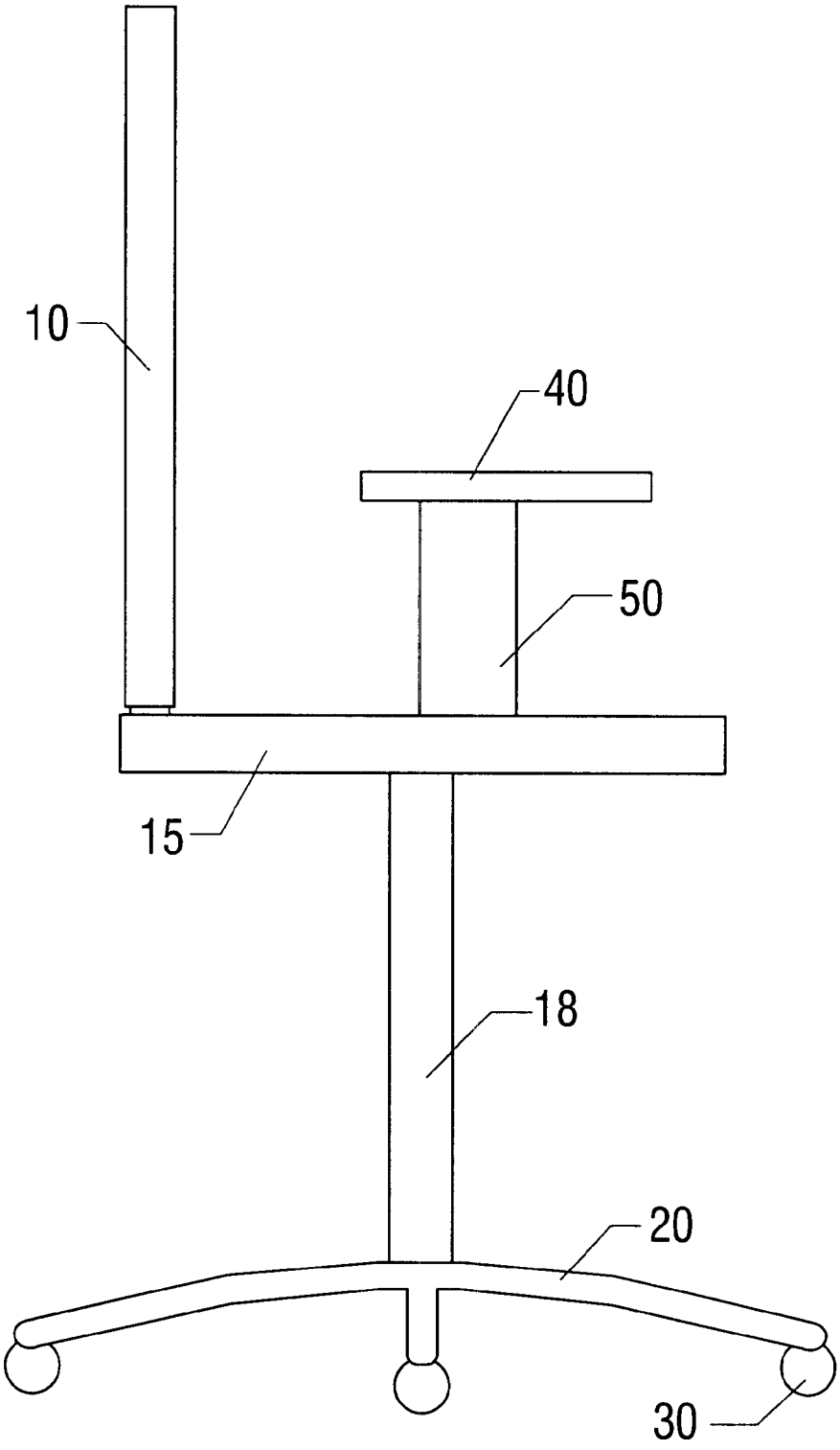
FIG. 2 (Prior Art)
FIG. 2 shows a simplified version of the prior art chair shown in FIG. 1.

Referring to FIG. 1, a prior art industrial chair is shown to be made up for a chair back 10, arm rests 40, chair arm 50, a seat 15, resting on a support column 18 supported by chair legs 20 and chair rollers 30. Chair legs 14 are substantially horizontally extending legs. In operation a person (not pictured) sits in seat 15. Although a traditional, industry-standard star-base office chair is shown, the invention is not so restricted. For instance, the support can be utilized in conjunction with four-legged chair or any other types of chairs desired by a user. FIG. 2 shows a simplified version of the prior art chair shown in FIG. 1.

Figure 3A:
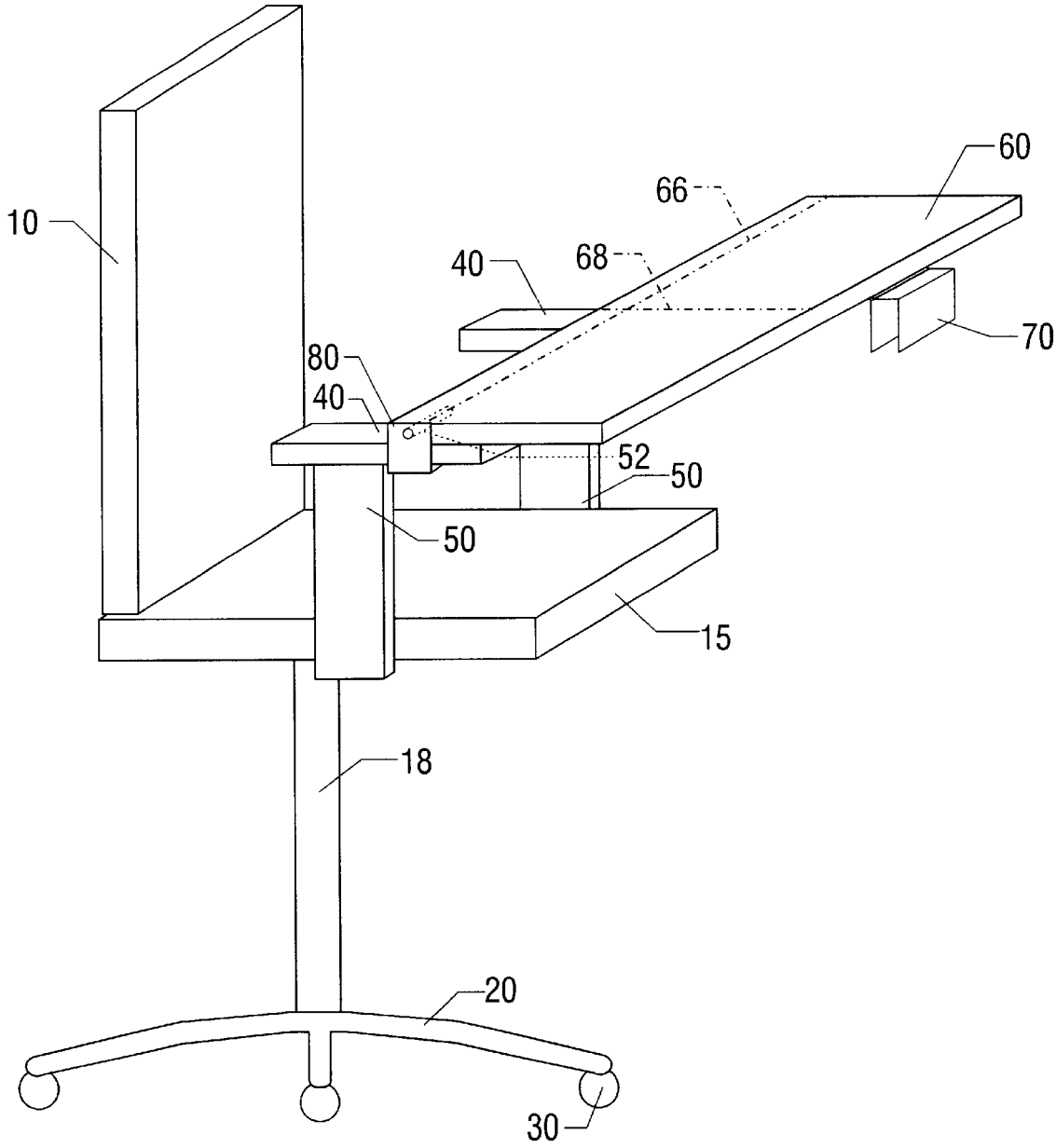
FIG. 3A shows one embodiment of the present invention in which the apparatus is mounted on the chair arm.

Referring to FIG. 3A, deck 60, which is substantially flat and rectangular in this embodiment, is shown having first longitudinal axis 66 perpendicular to a first horizontal axis 68. Deck 60 may be constructed of any material, of any dimensions, and of any shape. For instance, a phenolic board twenty six inches long, ten inches wide, and ¼ inch thick may be used. A first attachment means 80 is shown connecting deck 60 to chair arm rest 40. Of course, first attachment means 80 could also connect deck 60 directly to chair arm 50. First attachment means 80 can be a simple spring-loaded clamp common in the industry. Or first attachment means 80 could be a C-clamp secured to said chair arm rest 40 via a tightening bolt. Or first attachment means could be connected via a gravity shoulder resting on arm rest 40. Thus, first attachment means using magnets, or Velcro, or other attachment means known to one of ordinary skill in the art having the benefit of the disclosure of this application, could be utilized.

Figure 3B:
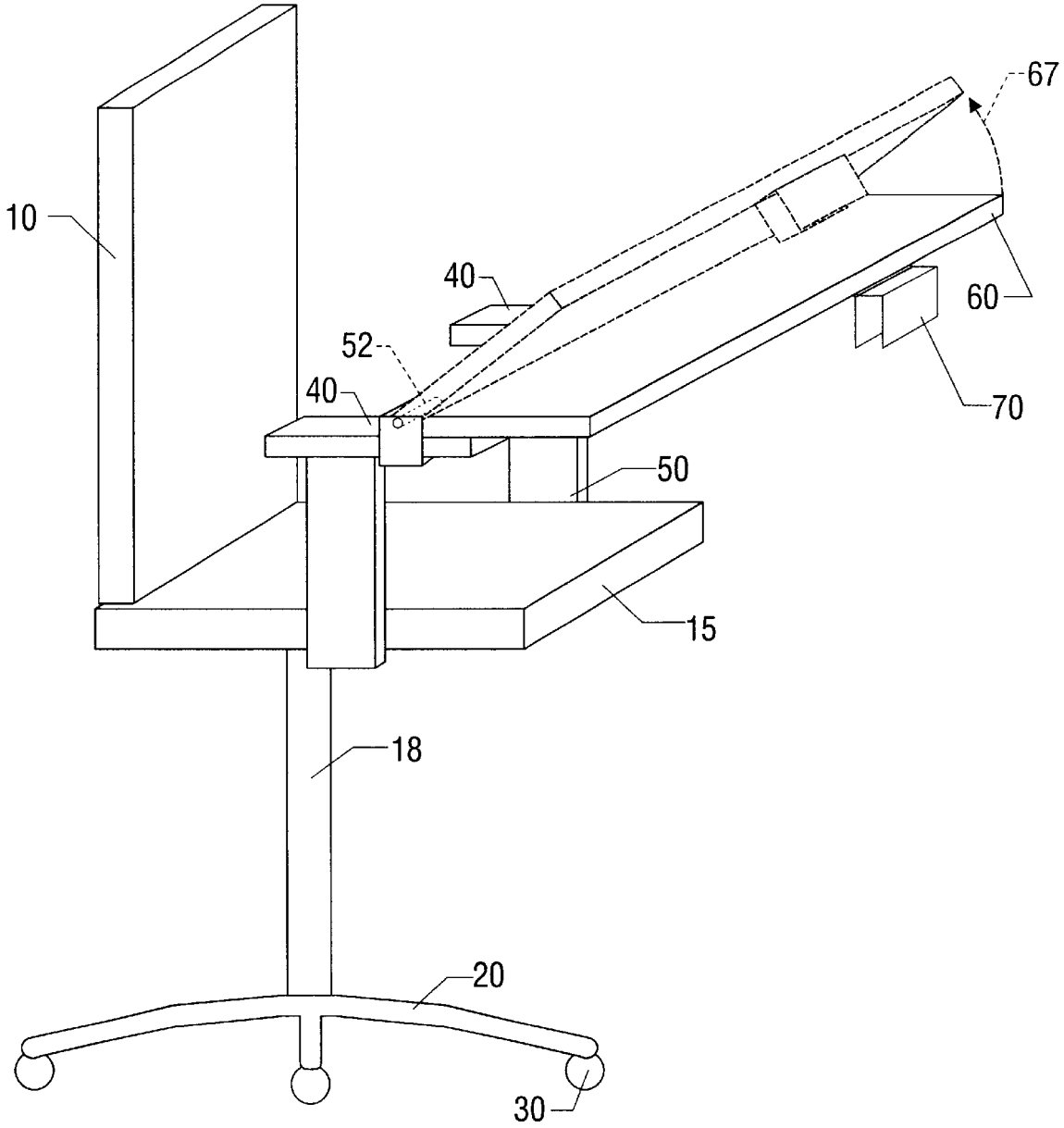
FIG. 3B shows the embodiment of FIG. 3A with the.deck tilted.

A first tilt pivot 52 is shown. First tilt pivot 52 is a bolt which generally holds the deck at a given angle from a horizontal plane unless additional force is applied by the user to change the angle. FIG. 3B shows deck 60 at an angle 67 from the horizontal plane.

In operation, a user (not shown) may attach deck 60 to chair arm rest 40 via first attachment means 80, such as by clamping said deck 60 to chair arm rest 40. The user may then place accessories, such as a computer keyboard, a mouse, a laptop computer, onto deck 60. By applying force to the deck, the user may tilt deck 60 at an angle 67 from a horizontal plane (as shown in FIG. 3B), thus causing the first horizontal axis 68 to rotate about first tilt pivot 52 to form an angle 67 with the horizontal plane. In the embodiments shown in FIGS. 3A through 4B, a second attachment means 70 is shown attached to the deck 60, but not attached to the chair in any way.

Figure 4A:
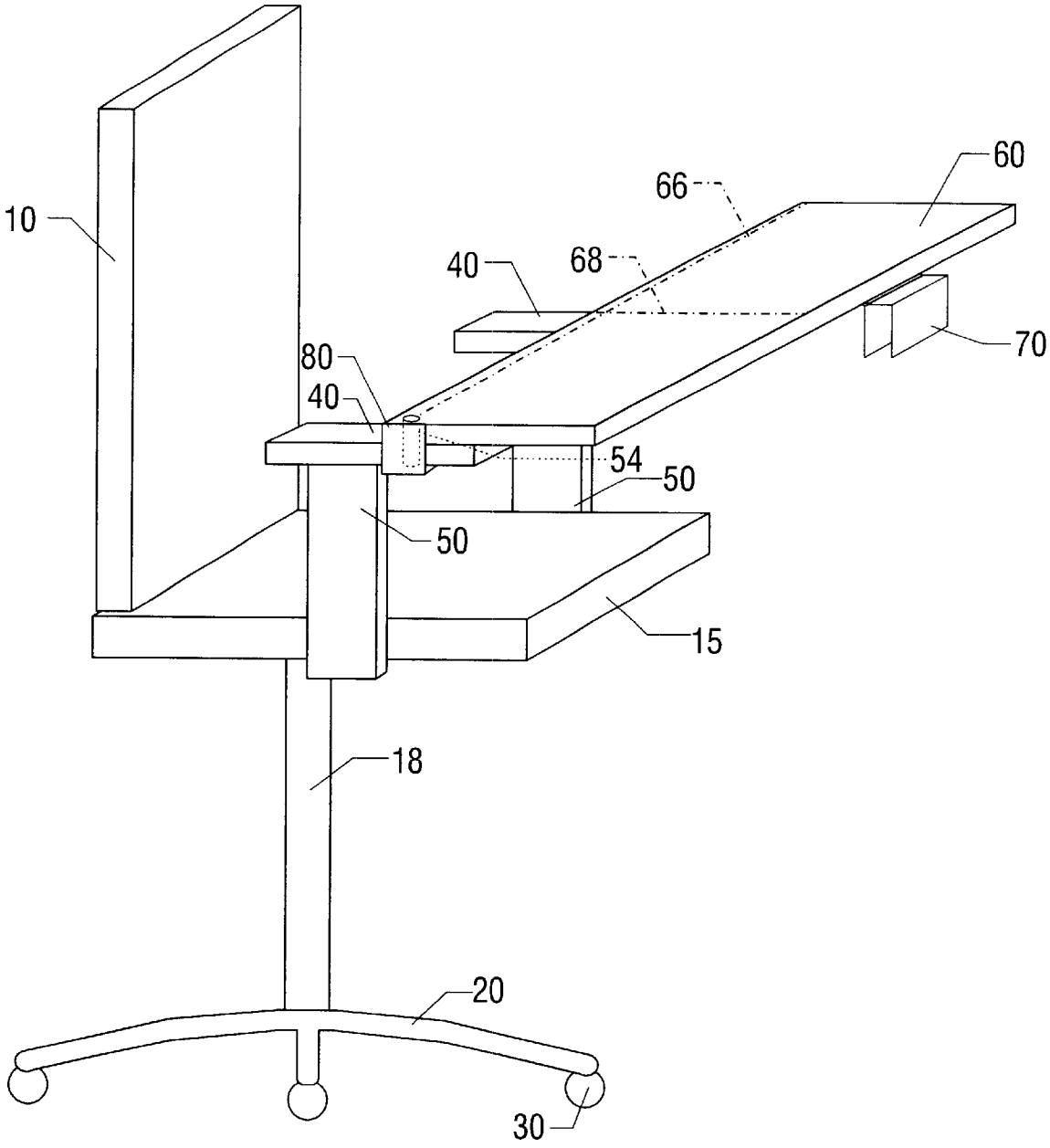
FIG. 4A shows the embodiment of the present invention detailing a first rotational pivot.
Figure 4B:
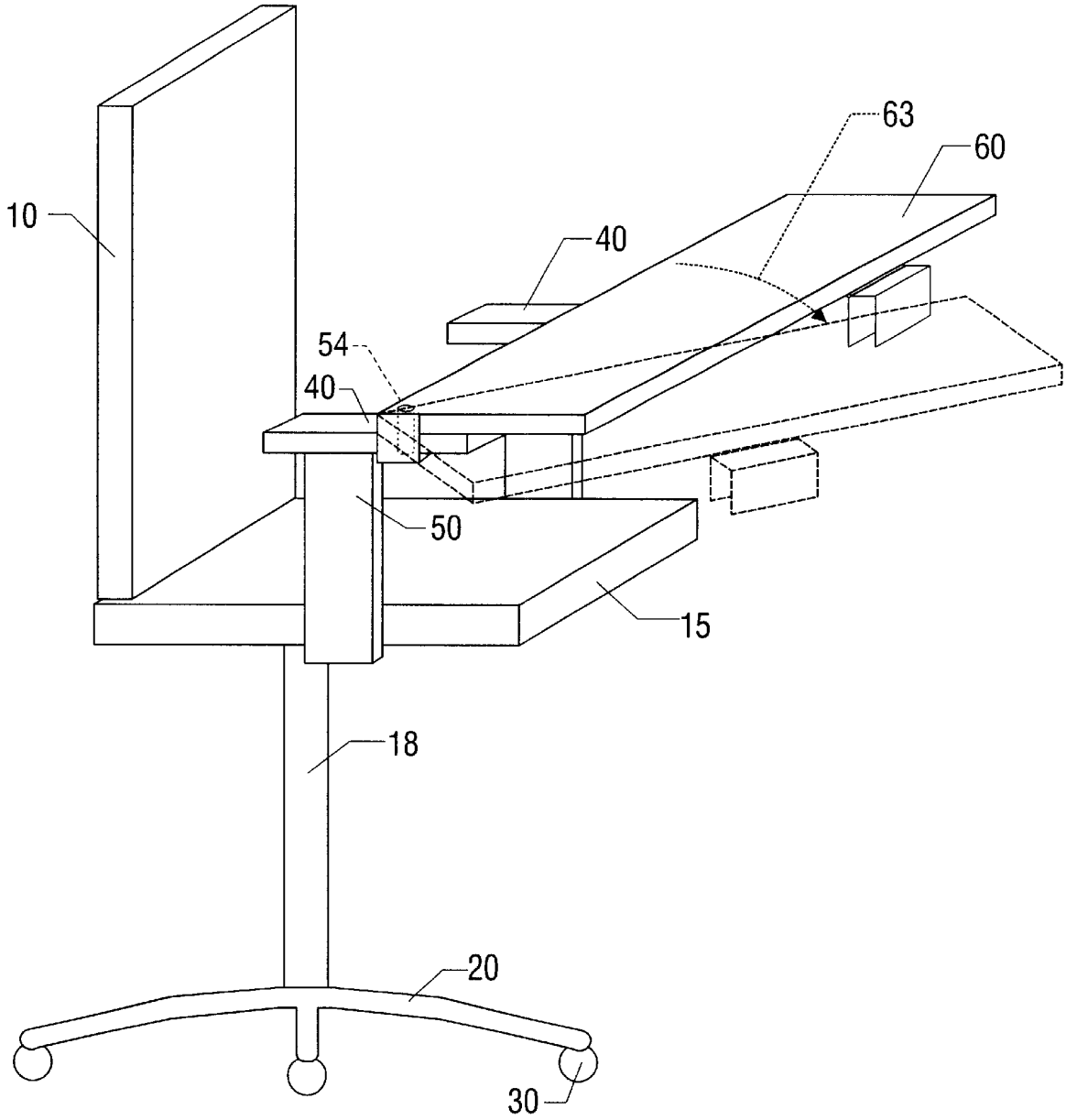
FIG. 4B shows the embodiment of FIG. 4A with the deck rotated.

Referring to FIG. 4A, first attachment means 80 is shown as comprising a first rotational pivot 54. First rotational pivot 54 may be a bolt which holds the deck 60 at a given location unless additional force is applied by the user to change the location. First rotational pivot 54 allows a user to rotate a first longitudinal axis 66 on deck 60 about first rotational pivot 54. FIG. 4B shows deck 60 rotated at an angle 63 with respect to the original position of deck 60. Angle 63 can be any value up to 360 degrees. Thus, as shown in FIGS. 3A through FIG. 4B, deck 60 may be tilted and rotated to accommodate the work-area preferences of multiple users. It should be noted that first tilt pivot 52 and first rotational pivot 54 may be combined into one mechanism which would provide for rotation about the two axes as described above. It should be noted that first attachment means 80 could also be attached to a desk for example. In this way, deck 60 can be utilized in the seated position by attaching first attachment means 80 to a desk, or by attaching second attachment means 70 to chair back 10.

Figure 5A:
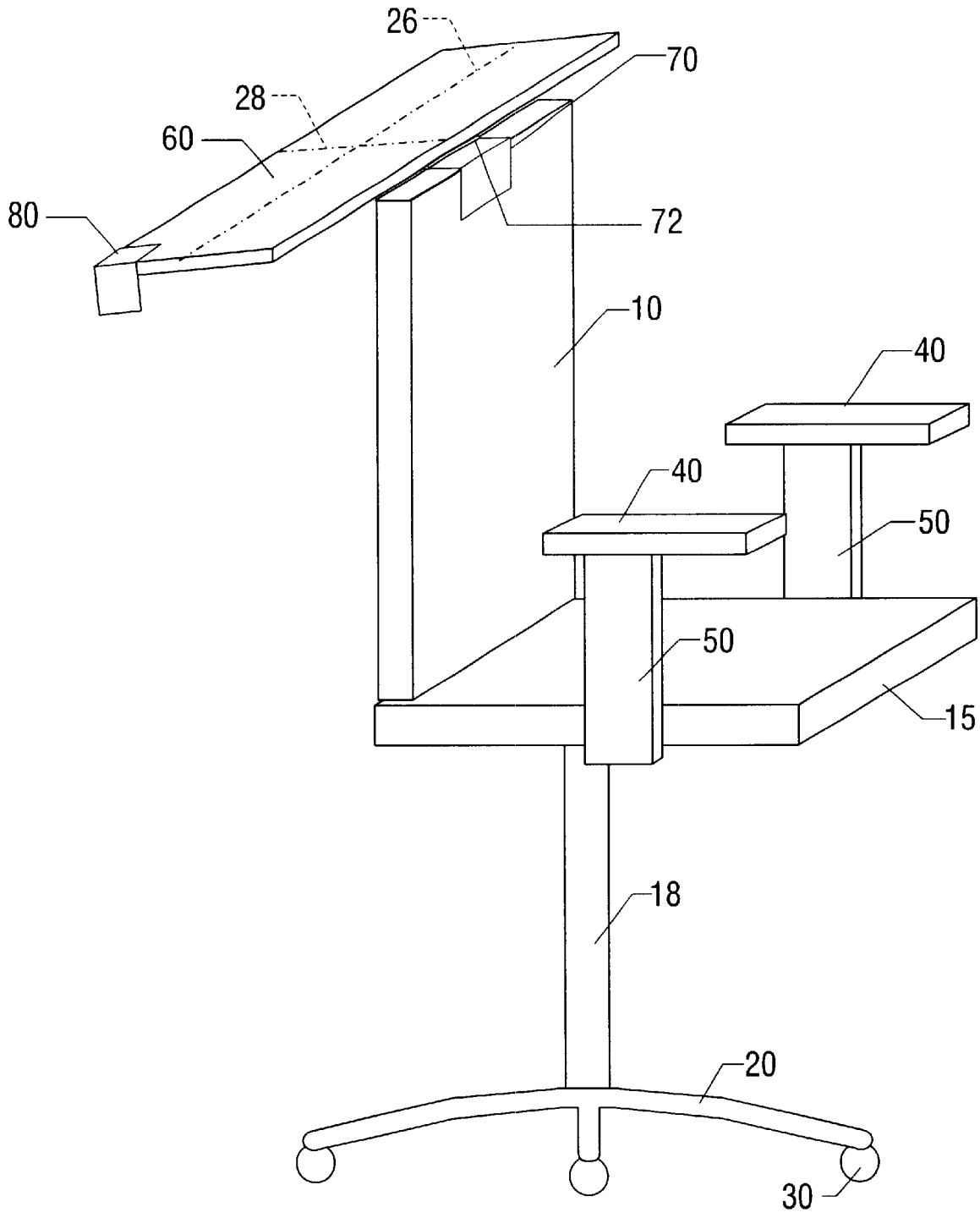
FIG. 5A shows one embodiment of the present invention in which the apparatus is mounted on the chair back.

Referring to FIGS. 5A to 9, an embodiment is shown with the deck 60 removably attached to chair back 10. In FIG. 5A, deck 60 is shown having second longitudinal axis 26 perpendicular to a second horizontal axis 28. First attachment means 80 is shown attached to the deck 60, but not to the chair in any way. Second attachment means 70 is shown attaching the deck 60 to the chair back 10 via a spring-clamping mechanism. Of course, second attachment means could consist of a C-clamp that is bolted to the chair back, or a gravity shoulder (shown in FIG. 7), or a custom bar (shown in FIG. 8) or any number of other releasable attachment methods known by those of ordinary skill in the art having the benefit of this disclosure. Thus, second attachment means 70 may be attached to chair back 10 using magnets, or Velcro, or other attachment means known to one of ordinary skill in the art having the benefit of the disclosure of this application.

Figure 5B:
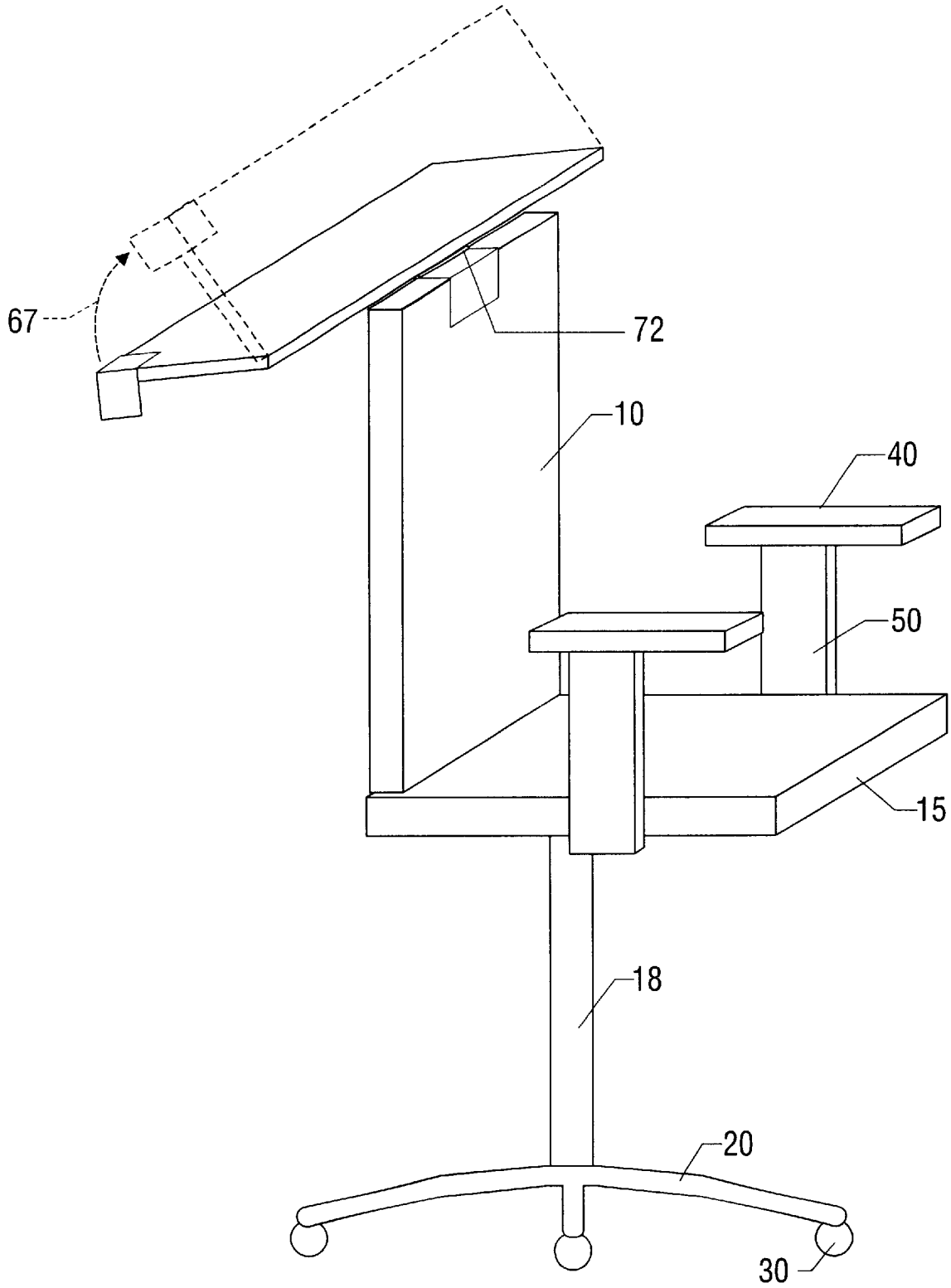
FIG. 5B shows the embodiment of FIG. 5A with the deck tilted.

A second tilt pivot 72 is shown as a simple hinge. Second tilt pivot 72 is generally a hinge which holds the deck at a given angle from a horizontal plane 67 unless additional force is applied by the user to change the angle. The user adjusts the location of the deck 60 as described for the embodiment of FIGS. 3A to 4B. By applying force to the deck 60, the user may tilt deck 60 at an angle 67 from a horizontal plane, thus causing the second horizontal axis 28 of deck 60 to rotate about second tilt pivot 72 as shown in FIG. 5B.

Figure 6A:
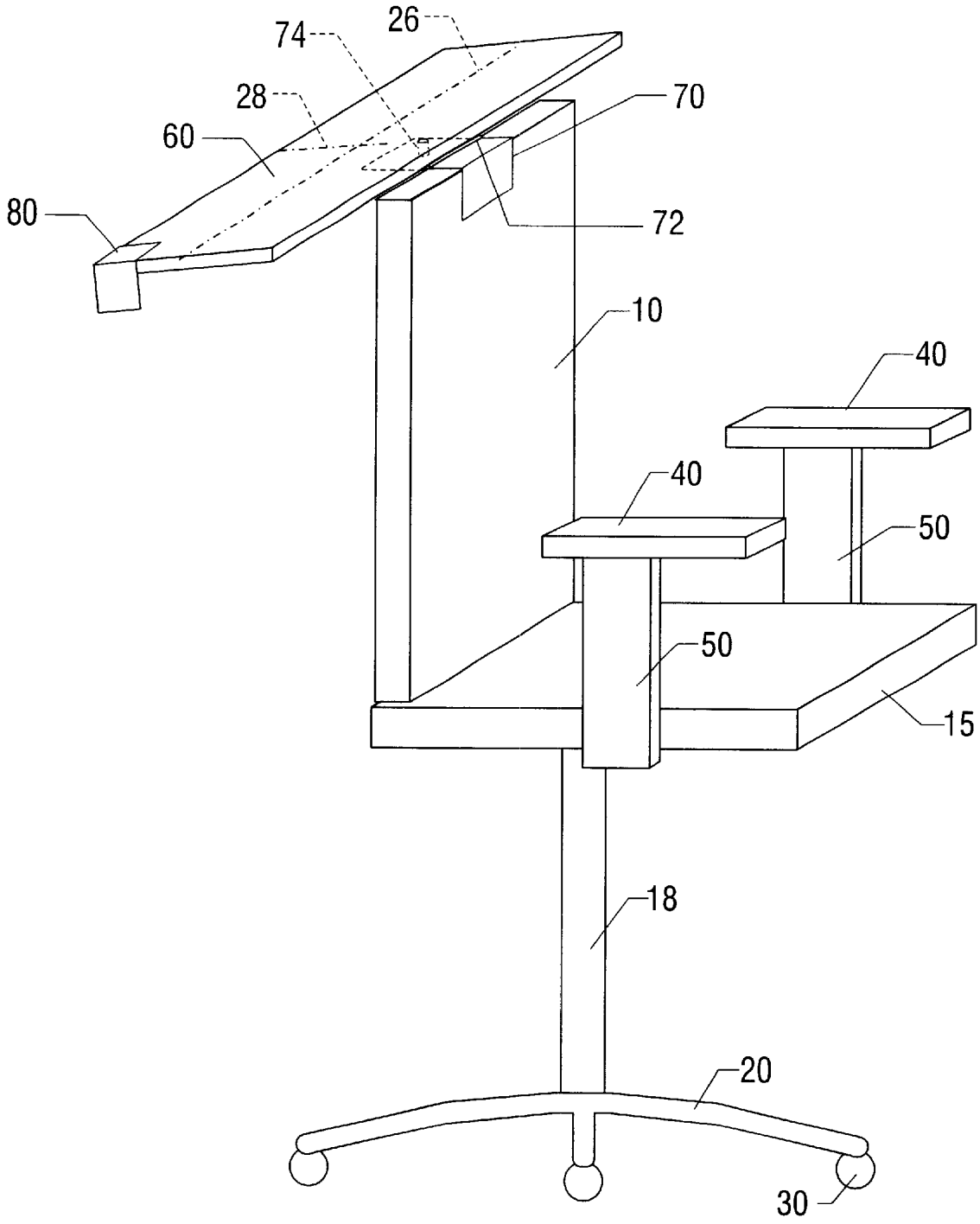
FIG. 6A shows an embodiment of the invention with the deck mounted on the chair back.
Figure 6B:
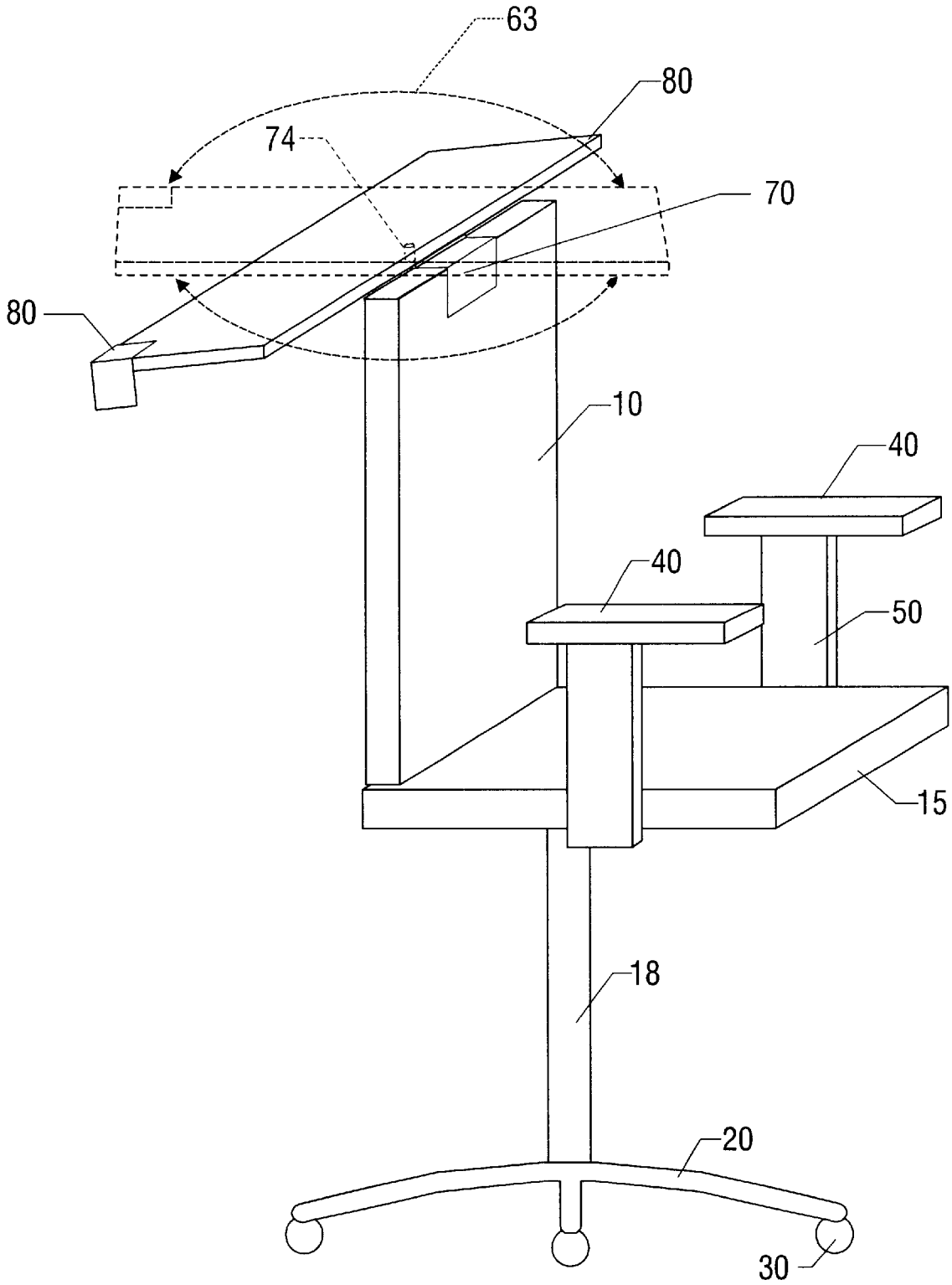
FIG. 6B shows the embodiment of FIG. 6A with the deck rotated.

Referring to FIG. 6A, the second attachment means 70 is shown as comprising a second rotational pivot 74. Second rotational pivot 74 may be a bolt which holds the deck 60 at a given location unless additional force is applied by the user to change the location. Second rotational pivot 74 allows a user to rotate a second longitudinal axis 66 on deck 60 about second rotational pivot 74. FIG. 6B shows deck 60 rotated at an angle 63 about second rotational pivot 74. Angle 63 can be any value from zero to 360 degrees to accommodate various users. Thus, as shown in FIGS. 5A to 6B, deck 60 may be tilted and rotated to accommodate the work-area preferences of multiple users.

It should be noted that second tilt pivot 72 and second rotational pivot 74 may be combined into one mechanism which would provide for rotation about the two axes as described above. For instance, second rotational pivot 74 could be mounted on a base which could be mounted via the hinge to second attachment means 70.

Figure 7:
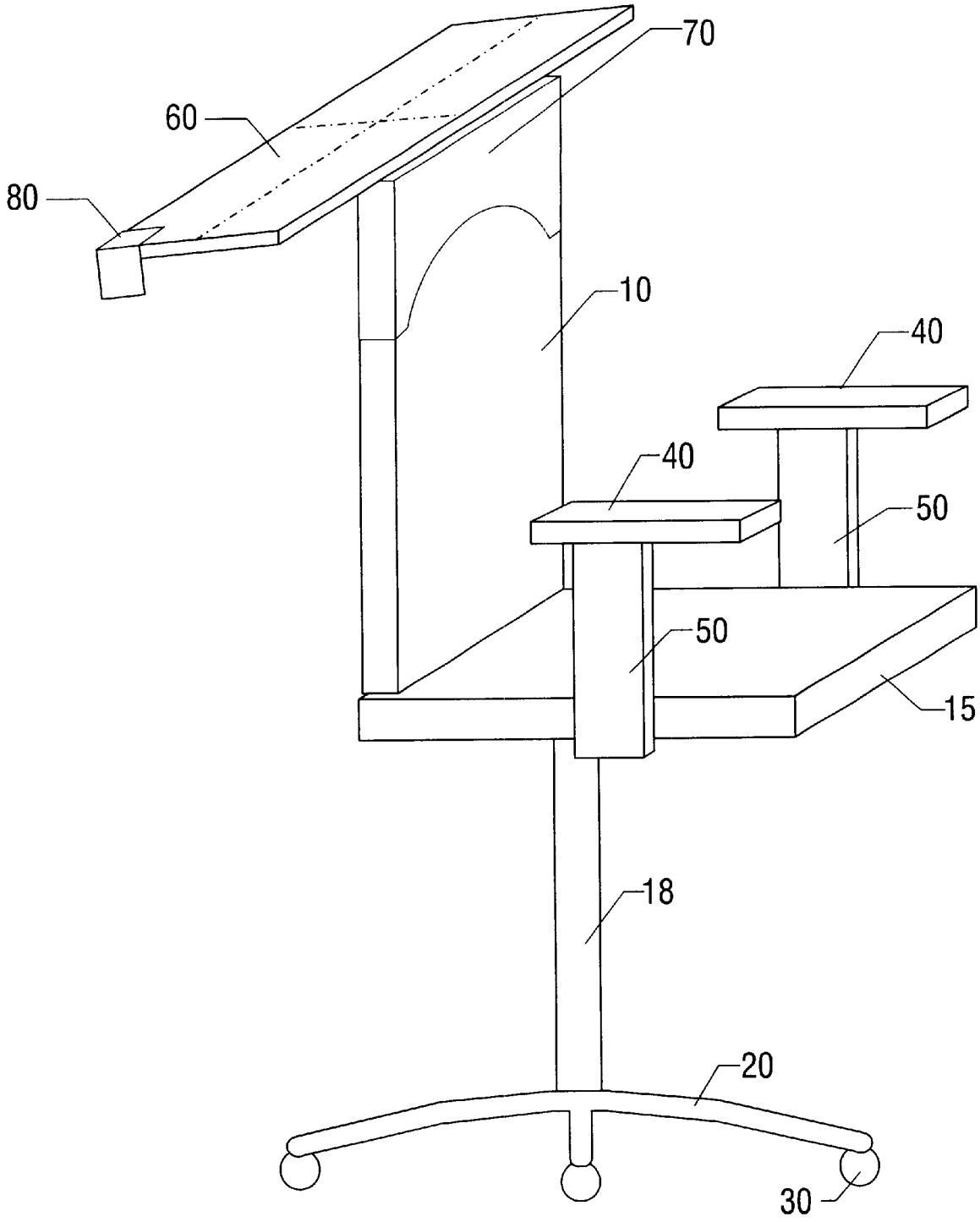
FIG. 7 shows another embodiment of the invention including a gravity shoulder.

FIG. 7 shows the second attachment means 70 as a gravity shoulder. The gravity shoulder operates to align the deck 60 atop chair back 10. Gravity holds the deck 60 in place. As with the embodiments of FIGS. 5A through 6B, deck 60 is attached to the gravity holder to allow the tilting and rotation previously described. First attachment means 60 can also comprise a gravity shoulder conformally shaped to position the tray atop either one arm rest 40 or two arm rests 40.

Figure 8:
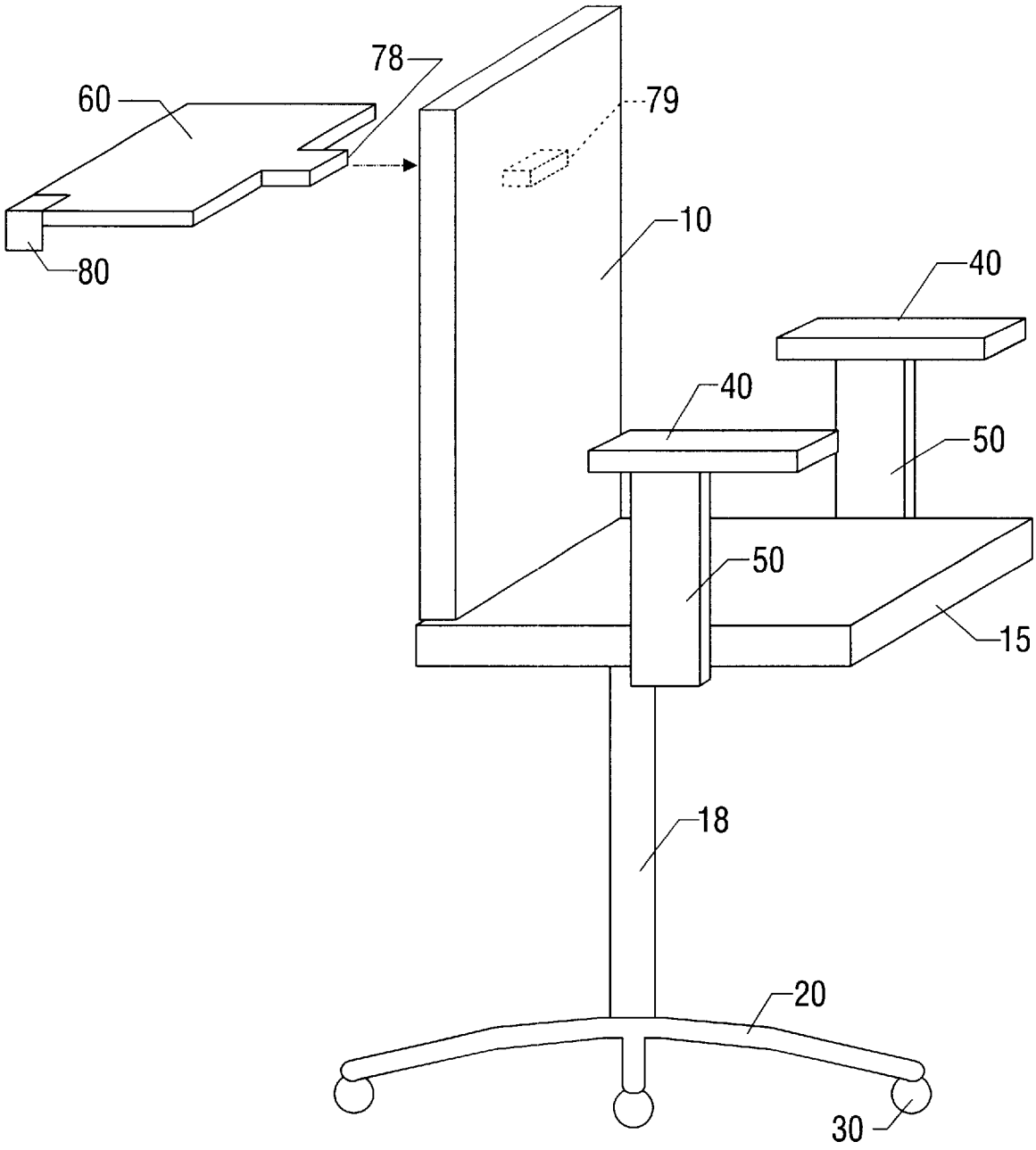
FIG. 8 shows another embodiment with the support attached to the chair back via a custom bar.

FIG. 8 shows second attachment means 70 being comprised of post 78 and slot 79 in a "custom bar" arrangement. Post 78 is a small cassette-sized protrusion that extends beyond the front underside of deck 60. Post 78 may be of any dimension capable of being supported via slot 79. Typically, a post one to two inches deep by three to four inches wide may be used. Slot 79 may be of any dimensions capable of mating with post 78 to hold deck 60 in a secure position when post 78 is mated with slot 79. Typically, a ¼" clearance is used. Further, slot 79 may be angled to securely hold deck 60 in its seated position during use. Quick connect and disconnect features known to one of ordinary skill in the art may be utilized to allow a secure connection of deck 60 to chair back 10 while also allowing rapid disconnecting of deck 60. Similarly, first attachment means 80 could similarly be comprised of a slot and post arrangement with the slot being located on the side of arm rest 40.

Figure 9:
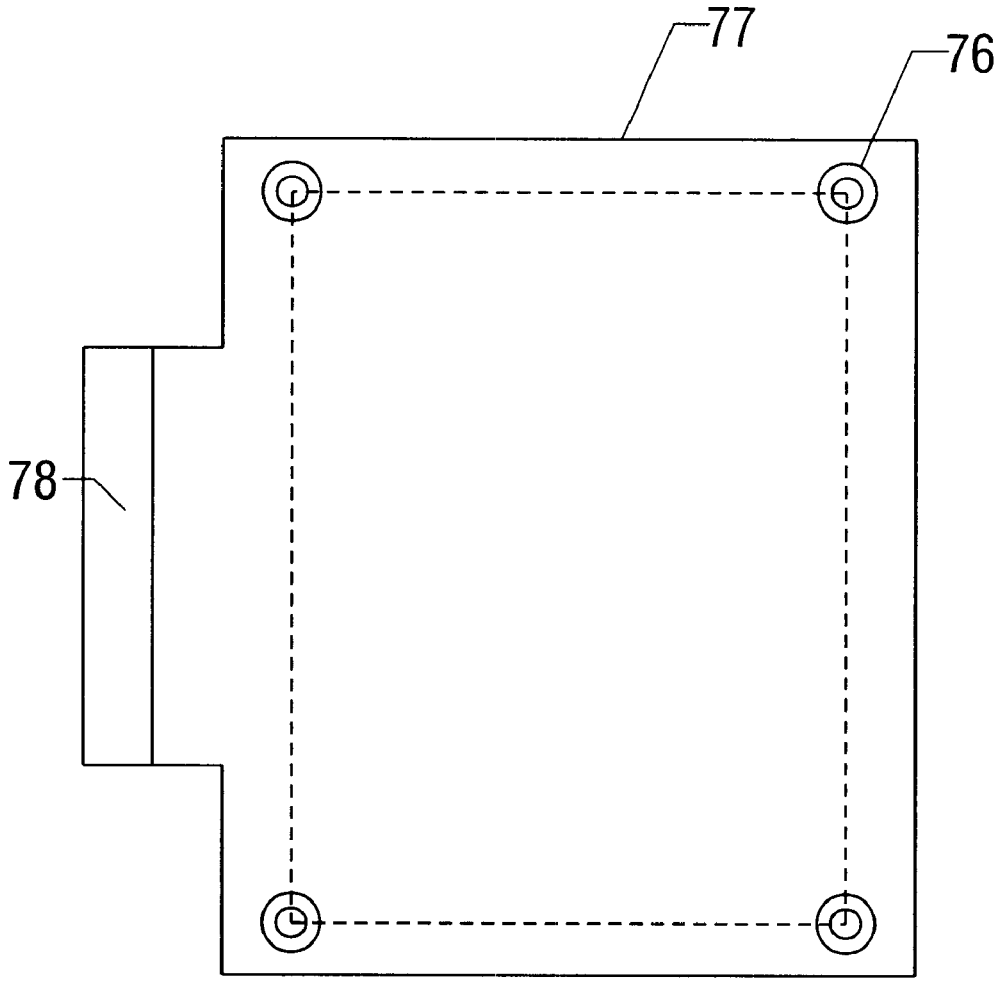
FIG. 9 shows an isolated view of components of the embodiment shown in FIG. 8.
Figure 10:
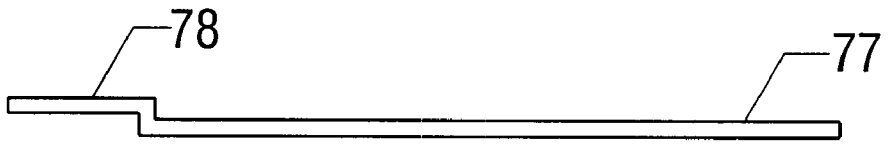
FIG. 10 shows an isolated view of components of the embodiment shown in FIG. 8.

FIGS. 9 and 10 show a top and side view of deck 60 in isolation having post 78 as described above in conjunction with FIG. 8. In this embodiment, a post support 77 is connected to deck 60 (not shown) via bolts and washers 76. Typical dimensions of the post support are seven inches (including post 78) by six inches. Post support 77 is attached in a plane perpendicular to post 78. FIG. 10 shows post 78 being offset, e.g. by 0.28", in a plane parallel to post 78.

Figure 11:
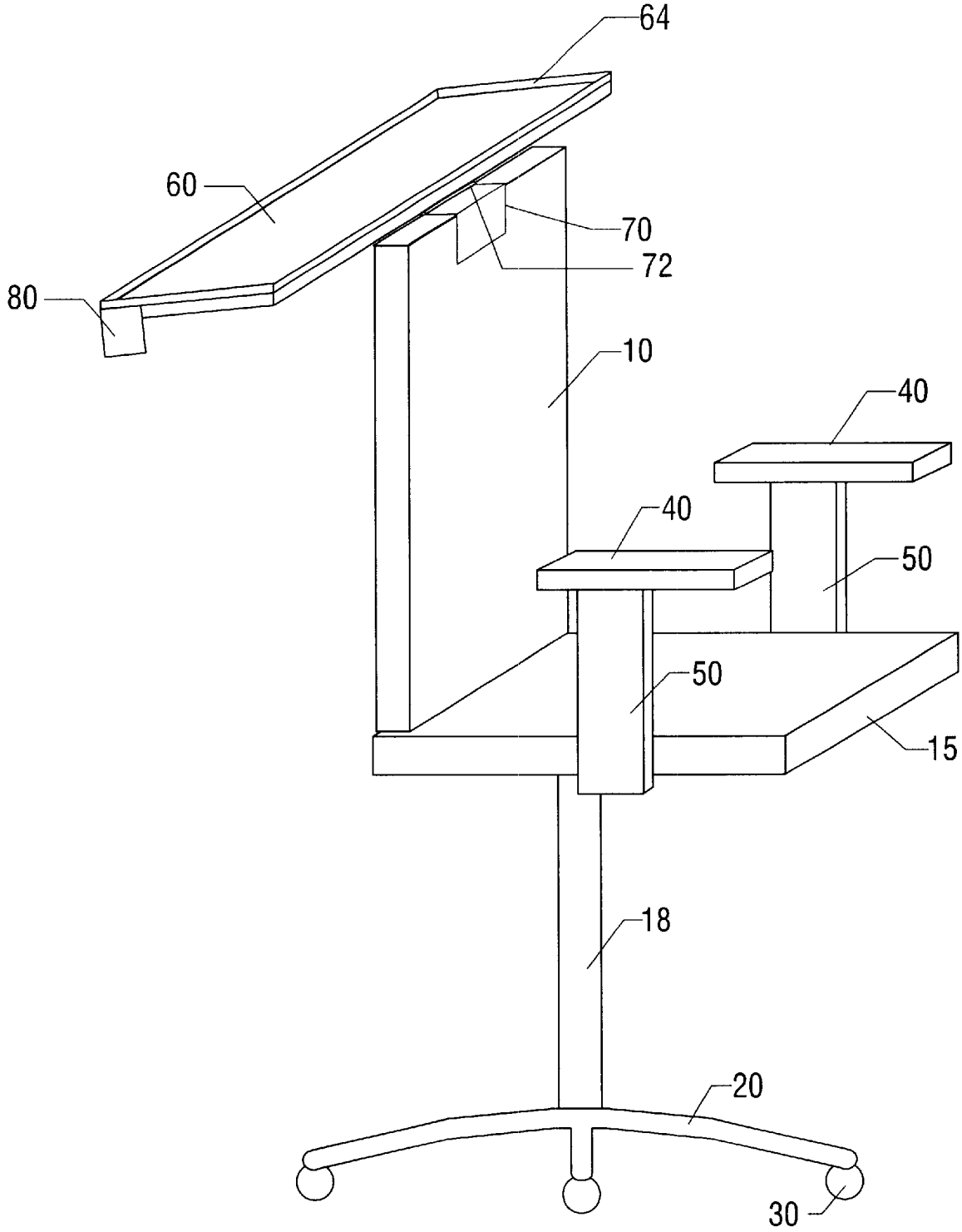
FIG. 11 shows an embodiment of the present invention with the deck having a raised edge.

FIG. 11 shows an embodiment of the present invention in which the deck 60 further comprises a raised edge 64. This raised edge 64 is located on the side of deck 60, and helps to prevent the accessories from falling off deck 60.

Figure 12:
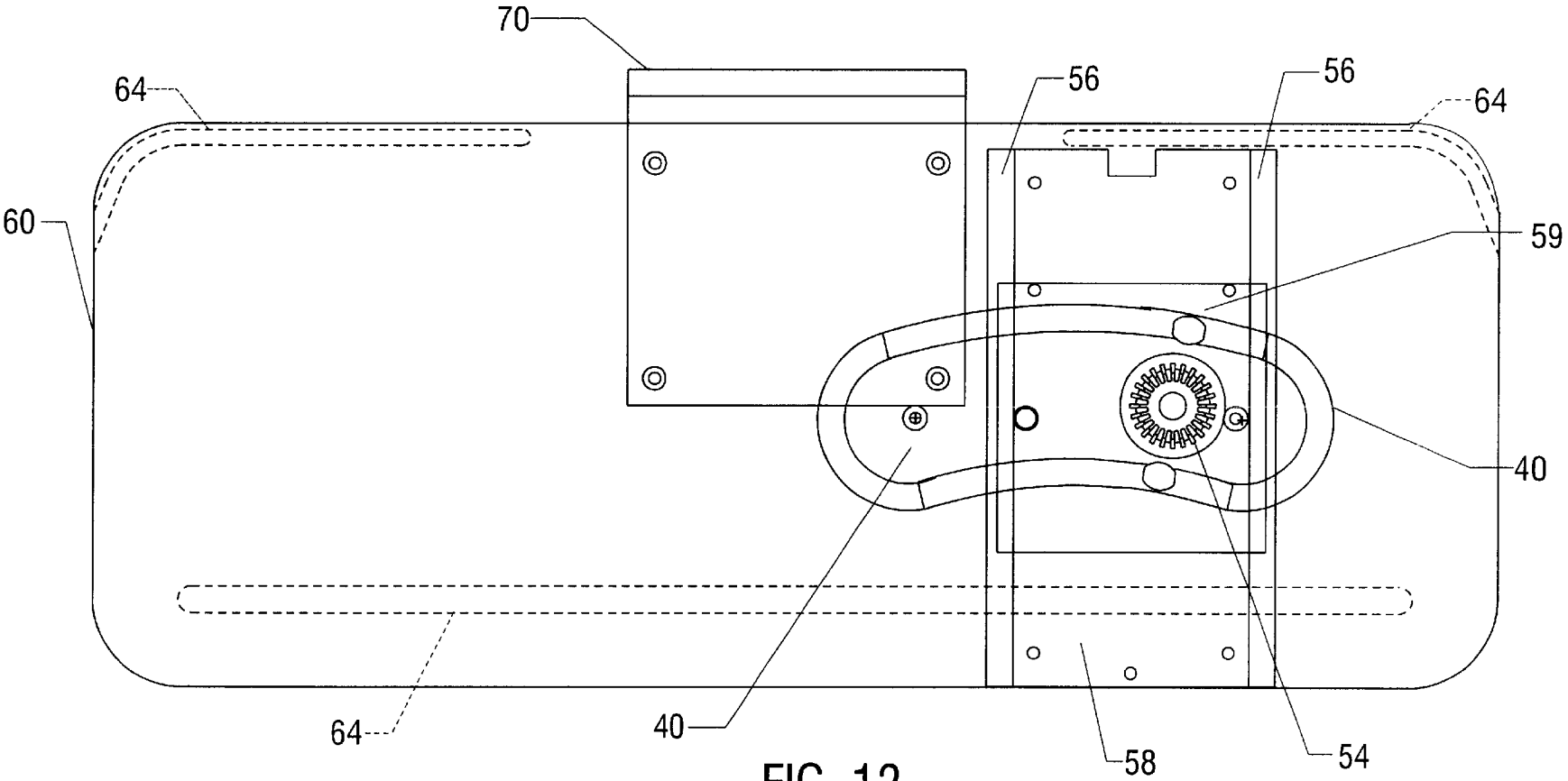
FIG. 12 shows an embodiment of the present invention including deck tracks.

FIG. 12 shows the bottom view of an embodiment of the present invention in which the raised edge 64 does not extend around the entire perimeter of deck 60. Deck 60 is attached to arm rest 40 as follows. Arm rest base 59 is securely attached to arm rest 40. Arm rest 40 is capable of rotating 180 degrees about first rotational pivot 54. Attached to deck 60 is deck base 58. Deck base 58 further comprises two deck tracks 56. Deck base 58 is moveably mounted to arm rest base 59 such that deck 60 is capable of moving away from or toward a user seated in the chair, while remaining securely attached to chair arm 50 (not shown). For instance, a friction slide mechanism allowing for four inches front to rear travel may be used. Further, arm rest base 59 may be moveably attached, via a hinge for example, to arm rest 40 to allow deck 60 to be tilted as described above. Second attachment means 70 is secured to deck 60 via bolts, screws, or the like.

Figure 13:
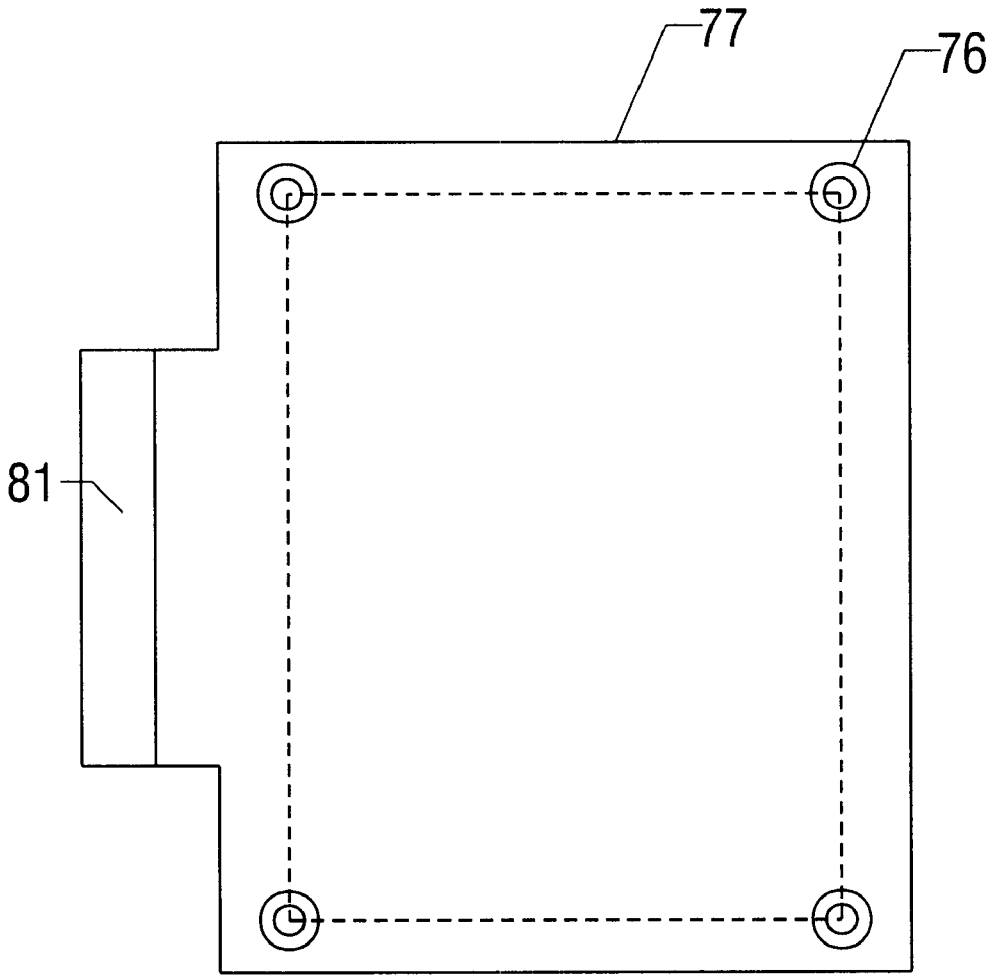
FIG. 13 shows an embodiment of the present invention showing a desk-mounting feature.
Figure 14:
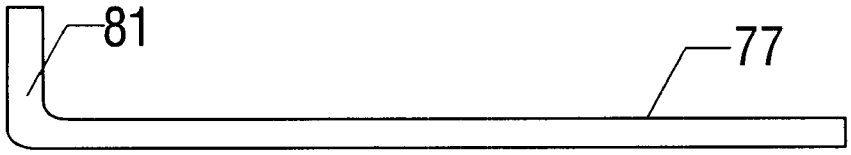
FIG. 14 shows a side view of the desk-mounting feature of FIG. 13.
Figure 15:
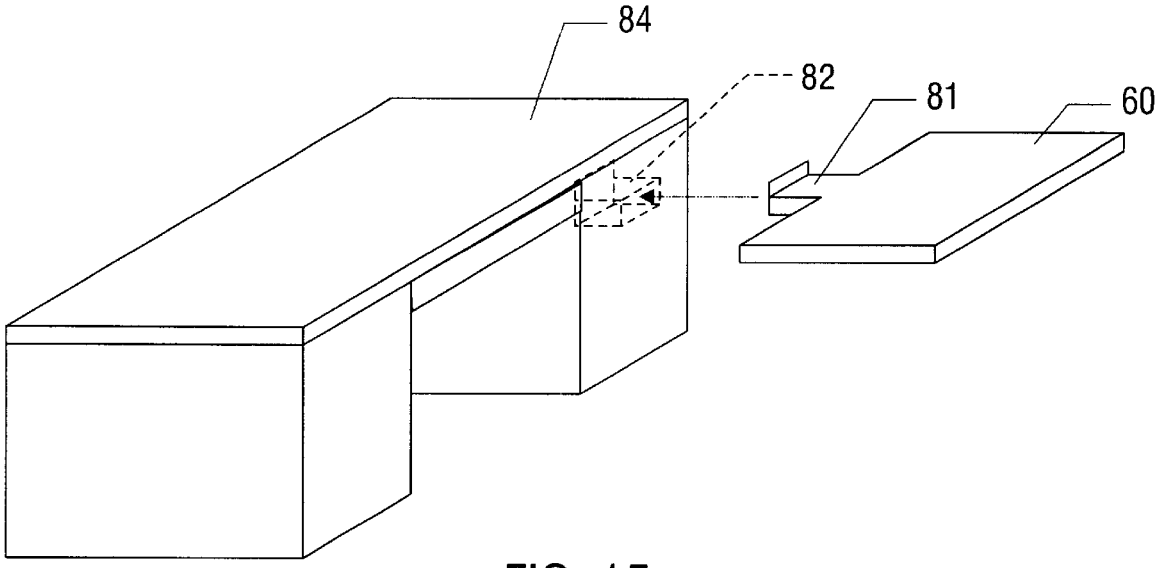
FIG. 15 shows an embodiment of the present invention with the deck attached to a desk.

FIGS. 13 through 15 show another embodiment of the present invention that utilizes a desk-mounting feature. FIGS. 13 and 14 show a top and side view of deck 60 in isolation having desk mount lip 81. In this embodiment, desk lip mount 81 is connected to deck 60 (not shown) via bolts and washers 76. Typical dimensions of the post support are seven inches (including post 78) by six inches. Post support 77 is attached to post 78. FIG. 10 shows post 78 being offset, e.g. by 0.28", in a plane parallel to post 78

FIG. 15 shows second attachment means 70 being comprised of desk mount lip 81 and desk socket 82. First attachment means 80 could also be comprised of desk mount lip 81 and desk socket 82, depending upon the user's desired configuration. Desk mount lip 81 is a small cassette-sized protrusion that extends beyond the front underside of deck 60. Desk mount lip 81 may be of any dimension capable of being supported via desk socket 82. Typically, a lip one to two inches deep by three to four inches wide may be used. Desk socket 82 may be of any dimensions capable of mating with desk mount lip 81 to hold deck 60 in a secure position when desk mount lip 81 is mated with desk socket 82. Typically, a ¼" clearance is used. Further, desk socket 82 may be angled to securely hold deck 60 in its seated position during use. Quick connect and disconnect features known to one of ordinary skill in the art may be utilized to allow a secure connection of deck 60 to desk 82 while also allowing rapid disconnecting of deck 60. Similarly, first attachment means 80 could similarly be comprised of a tip and socket arrangement with the socket being located on the side of arm rest 40. In this way, the deck can be attached to the desk as shown in FIG. 15, the chair arm as previously shown, or the chair back as shown in FIG. 8.

Figure 16A:
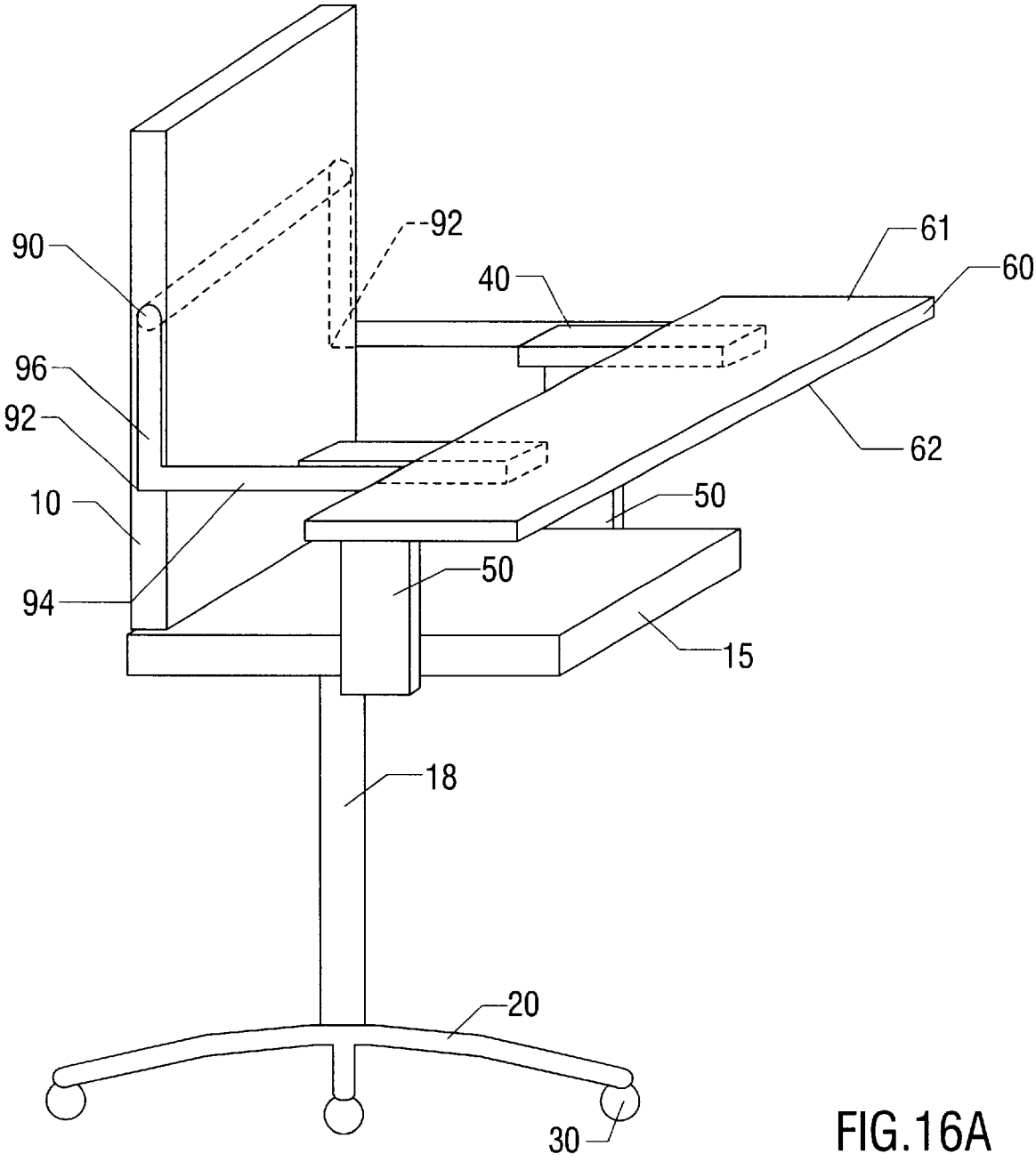
FIG. 16A shows an embodiment of the present invention that utilizes a flip-over arrangement with the deck resting on at least one chair arm or arm rest.
Figure 16B:
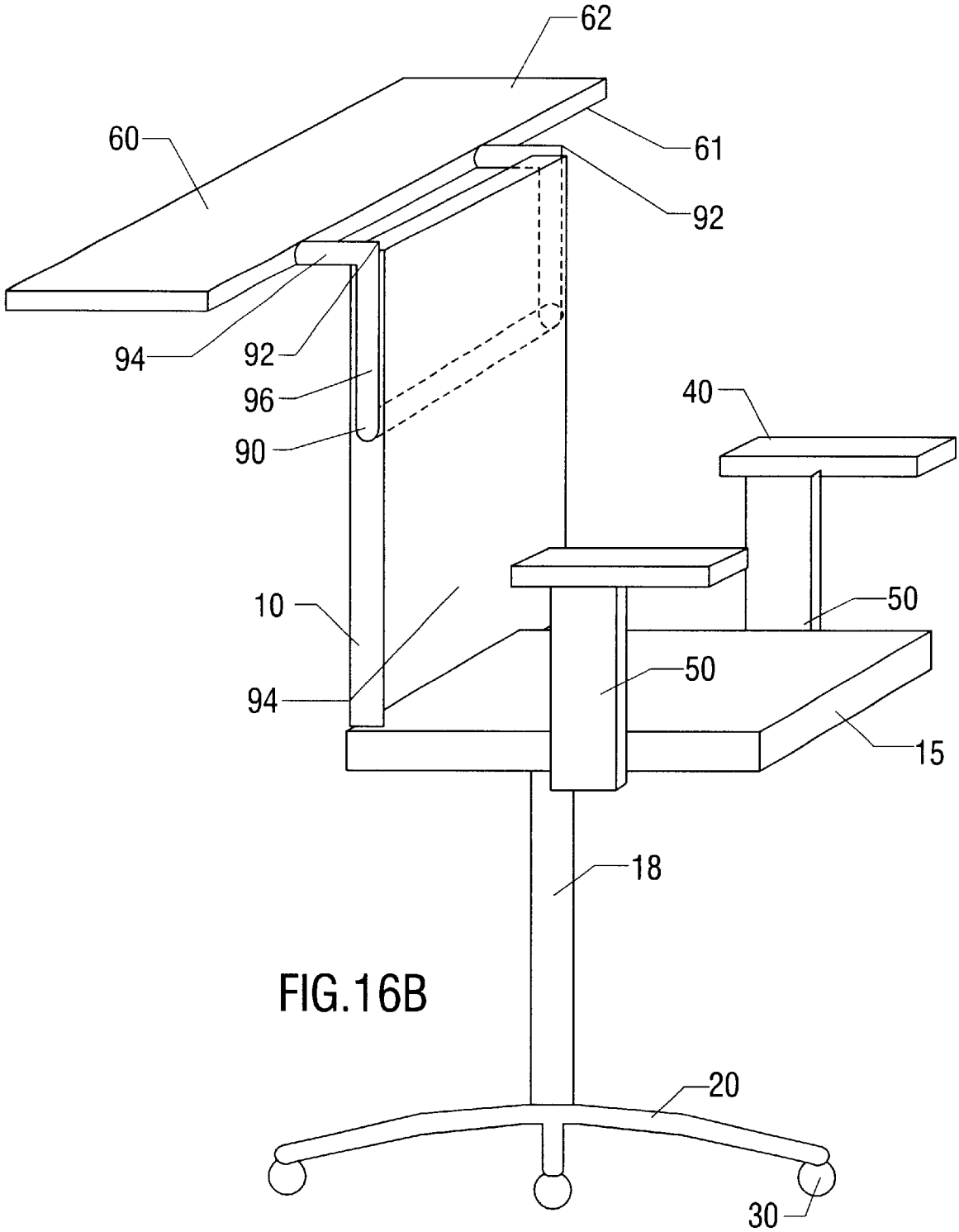
FIG. 16B shows the embodiment of that shown in FIG. 16A with using the deck resting on the chair back.

FIGS. 16A and 16B show an embodiment of the present invention which utilizes a flip-over arrangement. Referring to FIG. 16A, deck 60 is shown having two surfaces: an upper surface 61 and a bottom surface 62. Either bottom surface 62 or upper surface 61 may contain raised edges. A flip pivot 90 is located on chair back 10. A mounting bar 92 is connected to deck 60 and chair back 10. Mounting bar 92 may be of any configuration. However, shown in FIG. 16A, mounting bar 92 is comprised of first member 94 and second member 96. First member 94 and second member 96 joint at a right angle as shown, although other angles could also be utilized. As shown in FIG. 16A, accessories could be placed on upper surface 61 of deck 60. Bottom surface 62 contacts at least one arm rest 40 to support deck 60. In this way, a user could use the accessories on deck 60 while seated in the chair.

Shown in FIG. 16B is the same apparatus as discussed in 16A; however, in FIG. 16B, deck 60 has been rotated counter clockwise about flip pivot 90. Upper surface 61 of deck 60 now rests on chair back 10. Bottom surface 62 is now capable of supporting accessories such as a keyboard, mouse, or computer. This configuration may be utilized by a standing user. In this way, one piece of furniture may be utilized by a seated user or a standing user.

Although various embodiments have been shown and described, the invention is not so limited and will be understood to include all such modifications and variations as would be apparent to one skilled in the art.

The following table lists the description and the reference numbers as used herein and in the drawings attached hereto.

| Number | Name |
|---|---|
| 10 | Chair Back |
| 15 | Chair Seat |
| 18 | Chair Post |
| 20 | Legs |
| 26 | Second Longitudinal Axis |
| 28 | Second Horizontal Axis |
| 30 | Rollers |
| 40 | Armrest |
| 50 | Chair Arm |
| 52 | First Tilt Pivot |
| 54 | First Rotational Pivot |
| 60 | Deck |
| 61 | Upper Surface Of Deck 60 |
| 62 | Bottom Surface Of Deck 60 |
| 63 | Radial Angle |
| 64 | Raised Edge |
| 66 | First Longitudinal Axis |
| 67 | Angle From Horizontal Plane |
| 68 | First Horizontal Axis |
| 70 | Second Attachment Means |
| 72 | Second Tilt Pivot |
| 74 | Second Rotational Pivot |
| 77 | Post Support |
| 78 | Post |
| 79 | Slot |
| 80 | First Attachment Means |
| 81 | Desk Mount Lip |
| 82 | Desk Socket |
| 84 | Desk |
| 90 | Flip Pivot |
| 92 | Mounting Bar |
| 94 | First Member |
| 96 | Second Member |

What is claimed is:

1. An apparatus to support accessories on an adjustable-height chair having an armrest and a back, the apparatus for the accessories for use by a user in either a seated or a standing position, the apparatus comprising:

a deck having a substantially flat upper surface to hold accessories and a bottom surface;

a first attachment means connected to said deck, said deck being removably attachable to said armrest of said chair via said first attachment means for use when the accessories are used by the user in a seated position; and a second attachment means attached to said bottom surface of said deck, said deck being removably attachable to said back of said chair via said second attachment means for use when the accessories are used by the user in the standing position, wherein the height of the deck when attached to the back of the chair is adjustable by adjusting the height of the chair.

2. An apparatus to support accessories on an adjustable-height chair having an armrest and a back, the apparatus for the accessories for use by a user in either a seated or a standing position, the apparatus comprising:

a deck having a substantially flat upper surface to hold accessories, the deck having a first edge substantially perpendicular to a longitudinal axis on the deck and a second edge substantially parallel with said longitudinal axis on the deck;

a first attachment means connected to said first edge of said deck, said deck being removably attachable to said armrest of said chair via said first attachment means for use when the accessories are used by the user in a seated position; and a second attachment means attached to said second edge of said deck, said deck being removably attachable to said back of said chair via said second attachment means for use when the accessories are used by the user in the standing position, wherein the height of the deck when attached to the back of the chair is adjustable by adjusting the height of the chair.

3. The apparatus of claim 2 in which the deck further comprises a bottom surface, the second attachment means being attached to the bottom surface of said deck.

4. The apparatus of claim 2 in which the deck further comprises a raised edge to prevent the accessories from falling off said deck, said raised edge being located on a side of said deck.

5. The apparatus of claim 1 or 2 in which the second attachment means is a clamp.

6. An apparatus to support accessories on an adjustable-height chair having an armrest and a back having an upper surface, the apparatus for the accessories for use by a user in either a seated or a standing position, the apparatus comprising:

a means for supporting accessories having a first edge substantially perpendicular to a longitudinal axis on the means for supporting accessories and a second edge substantially parallel with said longitudinal axis on the means for supporting accessories;

a means for removably attaching said means for supporting accessories to said armrest of said chair, said means for removably attaching said means for supporting accessories to said armrest of chair being attached to said first edge of said means for supporting accessories for use when the accessories are used by the user in a seated position; and a means for removably attaching said means for supporting accessories to said back of said chair for use when the accessories are used by the user in the standing position, said means for removably attaching said means for supporting accessories to said back of said chair being attached to said second edge said means for supporting said accessories, wherein the height of the means for supporting said accessories when attached to the upper surface of the back of the chair is adjustable by adjusting the height of the chair.

7. The apparatus of claim 6 in which the second attachment means further comprises a tilt pivot to hold said deck at a given angle from a horizontal plain of said deck.

8. The apparatus of claim 7 in which said deck further comprises a horizontal axis, the deck rotating about said tilt pivot when said deck is tiled from the horizontal plane.

9. A method of attaching an apparatus to support accessories on a height-adjustable chair having an armrest and a back having an upper surface, the apparatus for the accessories for use by a user in a seated or in a standing position, comprising:

providing an apparatus to support accessories having a deck having a substantially flat upper surface to hold accessories and a bottom surface, the deck having a first edge substantially perpendicular to a longitudinal axis on the deck and a second edge substantially parallel with said longitudinal axis on said deck;

a first attachment means connected to said first edge of said deck, said deck being removably attachable to said armrest of said chair via said first attachment means for use when the accessories are used by the user in the seated position, and a second attachment means attached to said second edge of said deck, said deck being removably attachable to said upper surface of said back of said chair via said second attachment means, for use when the accessories are used by the user in the standing position;

attaching said apparatus to said arm rest via said first attachment means for use by a user in the seated position; placing said accessories on said deck;

removing the apparatus from the arm rest;

attaching said apparatus to said upper surface of said chair back via said second attachment means; and utilizing the accessories on the apparatus while a user is in the standing position.

* * * * *